US008740557B2

(12) United States Patent
Durocher

(10) Patent No.: US 8,740,557 B2
(45) Date of Patent: Jun. 3, 2014

(54) FABRICATED STATIC VANE RING

(75) Inventor: Eric Durocher, Vercheres (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1231 days.

(21) Appl. No.: 12/571,863

(22) Filed: Oct. 1, 2009

(65) Prior Publication Data

US 2011/0081239 A1 Apr. 7, 2011

(51) Int. Cl.
*F01D 9/04* (2006.01)

(52) U.S. Cl.
USPC ..... 415/191; 415/209.4; 415/210.1; 416/213 R

(58) Field of Classification Search
USPC ..... 415/142, 182.1, 183, 185, 191, 209.3, 415/209.4, 210.1; 416/213 R; 29/889.72
See application file for complete search history.

(56) References Cited

U.S. PATENT DOCUMENTS

| | | | | |
|---|---|---|---|---|
| 2,117,107 | A | 5/1938 | Soderberg | |
| 2,771,622 | A | 11/1956 | Thorp, II | |
| 3,004,750 | A | 10/1961 | Broders | |
| 3,967,353 | A | 7/1976 | Pagnotta et al. | |
| 4,704,066 | A * | 11/1987 | Weissbacher | 415/191 |
| 5,181,550 | A * | 1/1993 | Blazek et al. | 164/100 |
| 5,332,360 | A | 7/1994 | Correia et al. | |
| 5,474,419 | A * | 12/1995 | Reluzco et al. | 415/209.4 |
| 5,609,467 | A * | 3/1997 | Lenhart et al. | 415/142 |
| 5,735,672 | A | 4/1998 | Mrotek | |
| 6,524,072 | B1 | 2/2003 | Brownell et al. | |
| 6,543,998 | B1 * | 4/2003 | Scharl | 415/209.3 |
| 7,100,358 | B2 * | 9/2006 | Gekht et al. | 60/39.5 |
| 7,387,493 | B2 | 6/2008 | Smith et al. | |
| 2008/0078079 | A1 * | 4/2008 | Ellis et al. | 29/889.1 |

* cited by examiner

*Primary Examiner* — Edward Look
*Assistant Examiner* — Jesse Prager
(74) *Attorney, Agent, or Firm* — Norton Rose Fulbright Canada LLP

(57) ABSTRACT

A strut configuration of a static vane ring used in a gas turbine engine having an enlarged end section at least at one of the opposed ends thereof to be welded or brazed to either an outer or inner duct wall of the vane ring. The enlarged end section provides a inner corner curve with a predetermined fillet radius between the strut and the duct wall.

16 Claims, 4 Drawing Sheets

FABRICATED STATIC VANE RING

TECHNICAL FIELD

The described subject matter relates generally to gas turbine engines and more particularly, to a static vane ring used in a gas turbine engine.

BACKGROUND OF THE ART

A static vane ring generally includes a plurality of radial struts extending between, and interconnecting outer and inner gas path duct walls of the vane ring. Vane rings may be cast, or may be fabricated from sheet metal. As schematically illustrated in FIGS. 9 and 10, in a fabricated sheet metal assembly, an end of the strut is directly welded to the respective outer and inner annular duct walls of the vane ring. However, high stresses may be observed at the junction of the strut and the duct wall.

Accordingly, there is a need to provide an improved fabricated static vane ring for gas turbine engines.

SUMMARY

In accordance with one aspect, the described subject matter provides a static vane ring for a gas turbine engine comprising an annular duct defined between an annular outer duct wall and an annular inner duct wall, each of the outer and inner duct walls defining a gas path surface and a back surface opposed to the gas path surface; a circumferential array of aerodynamic struts extending radially across the duct and interconnecting the outer and inner duct walls wherein each strut has at least one enlarged end including an enlarged section extending laterally and outwardly from a transit radial portion, and a fillet radius between the transit radial portion and the enlarged section, the enlarged section received in an opening defined in a corresponding one of the outer and inner duct walls, and wherein a welded or brazed joint extends between the corresponding back surface and the enlarged section.

In accordance with another aspect, the described subject matter provides a strut configuration for radially interconnecting outer and inner duct walls of a static vane ring used in a gas turbine engine, the strut comprising a body portion with opposed end portions, each of the end portions including a transit radial portion extending from the body portion and an enlarged section extending laterally and outwardly from the transit radial portion, and a fillet radius between the transit radial portion and the enlarged section, the transit radial portion being integrated with the body portion such that an outer surface smoothly extends from the body portion to the transit radial portion, each enlarged section having a profile substantially similar to a cross-sectional aerodynamic profile of the adjacent transit radial portion, adapted to be integrated with one of the outer and inner duct walls of the static vane ring.

Further details of these and other aspects of the present invention will be apparent from the detailed description and drawings included below.

DESCRIPTION OF THE DRAWINGS

Reference is now made to the accompanying drawings depicting aspects of the described subject matter, in which.

DETAILED DESCRIPTION OF THE PREFERRED EMBODIMENTS

Figure 1:
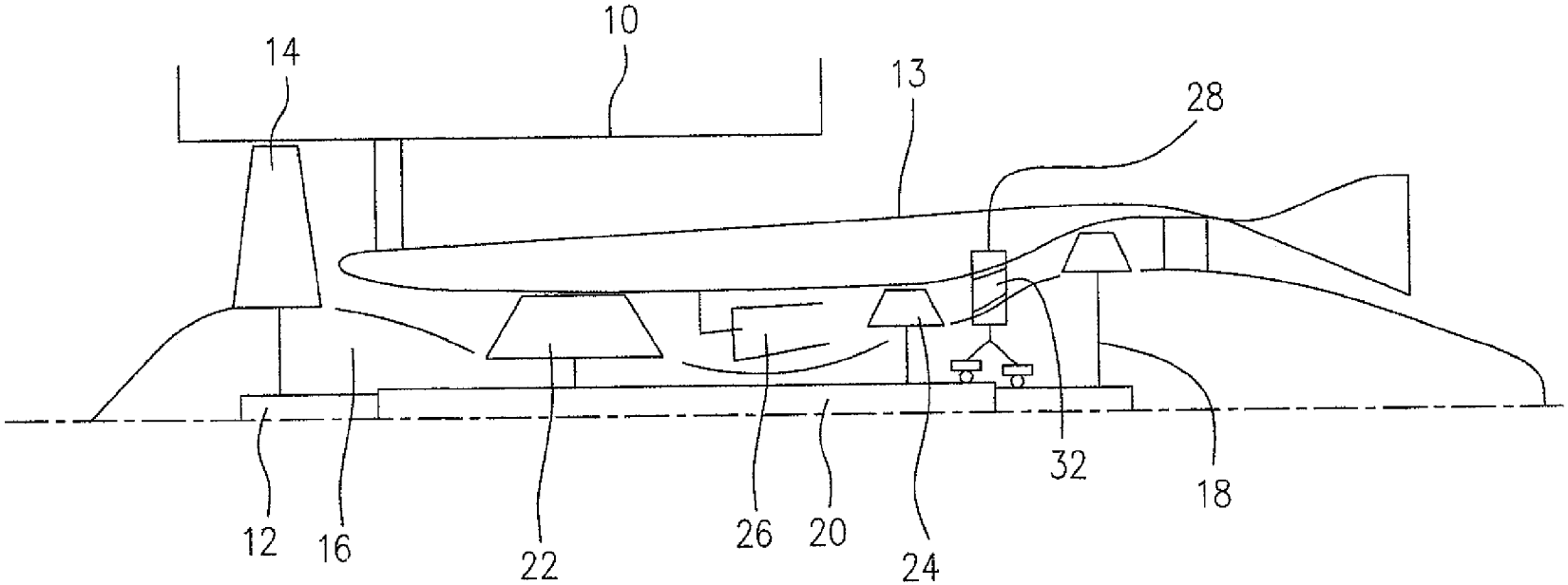
FIG. 1 is schematic cross-sectional view of a turbofan gas turbine engine according to the present description.
Figure 2:
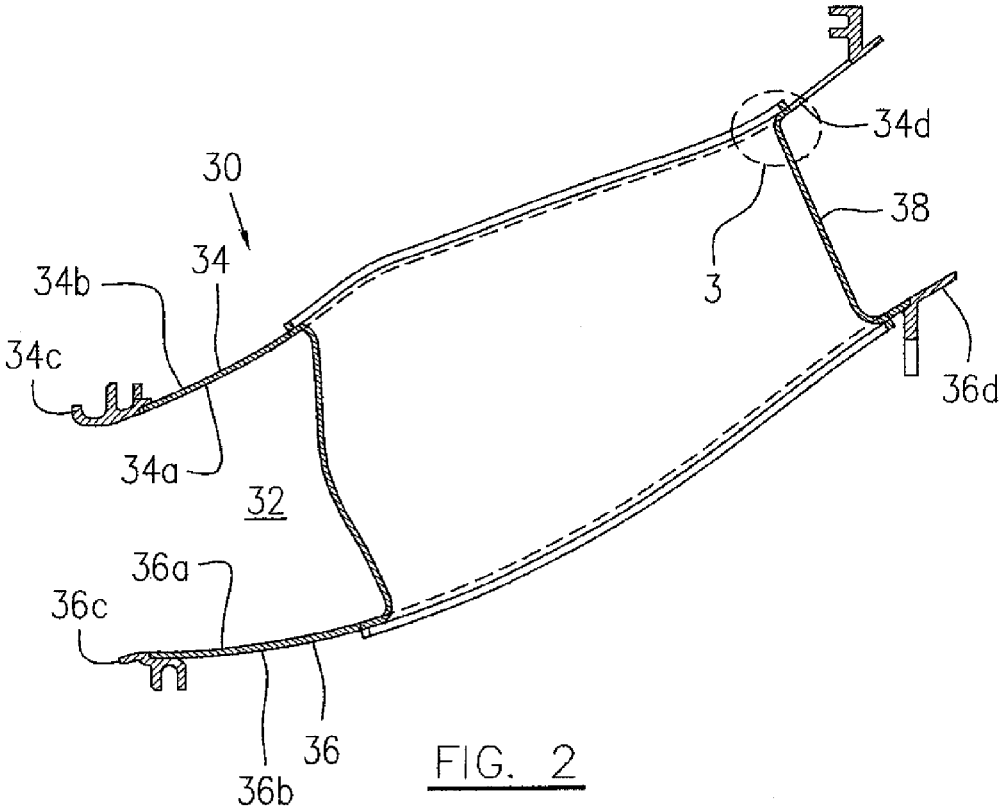
FIG. 2 is a cross-sectional view of a fabricated static vane ring used in the gas turbine engine of FIG. 1, according to one embodiment.

Referring to FIG. 1, a turbofan gas turbine engine includes a fan case 10, a core casing 13, a low pressure spool assembly (not numbered) which includes a fan assembly 14, a low pressure compressor assembly 16 and a low pressure turbine assembly 18 connected by a shaft 12, and a high pressure spool assembly (not numbered) which includes a high pressure compressor assembly 22 and a high pressure turbine assembly 24 connected by a turbine shaft 20. The core casing 13 surrounds the low and high pressure spool assemblies to define a main fluid path therethrough (not numbered). In the main fluid path there is provided a combustor 26 to generate combustion gases in order to power the high and low pressure assemblies 24, 18. A mid turbine frame 28 is disposed between the high and low pressure turbine assemblies 24 and 18 and includes an annular inter turbine duct (ITD) 32 therein for directing hot gases to pass therethrough from the high pressure turbine assembly 24 to the low pressure turbine assembly 18. The terms "axial" and "radial" used for various components below are defined with respect to the main engine axis shown but not numbered in FIG. 1.

It should be noted that similar components and features shown in various figures are indicated by similar numeral references and will not be redundantly described.

Referring to FIGS. 1-5, a static vane ring 30 which is supported within the mid turbine frame 28 defines the annular ITD 32 radially between an annular outer duct wall 34 and an annular inner duct wall 36. Each of the outer and inner duct walls 34, 36 defines a hot surface 34*a* or 36*a* exposed to the hot gases passing through the ITD 32 and a back surface 34*b* or 36*b* opposed the hot surface 34*a* or 36*a*. The outer and inner duct walls 34, 36 further define respective opposed axial 34*c*, 36*c*, and 34*d*, 36*d*. A plurality of struts 38 are provided, extending radially across the ITD 32 and interconnecting the outer and inner duct walls 34 and 36.

Figure 3:
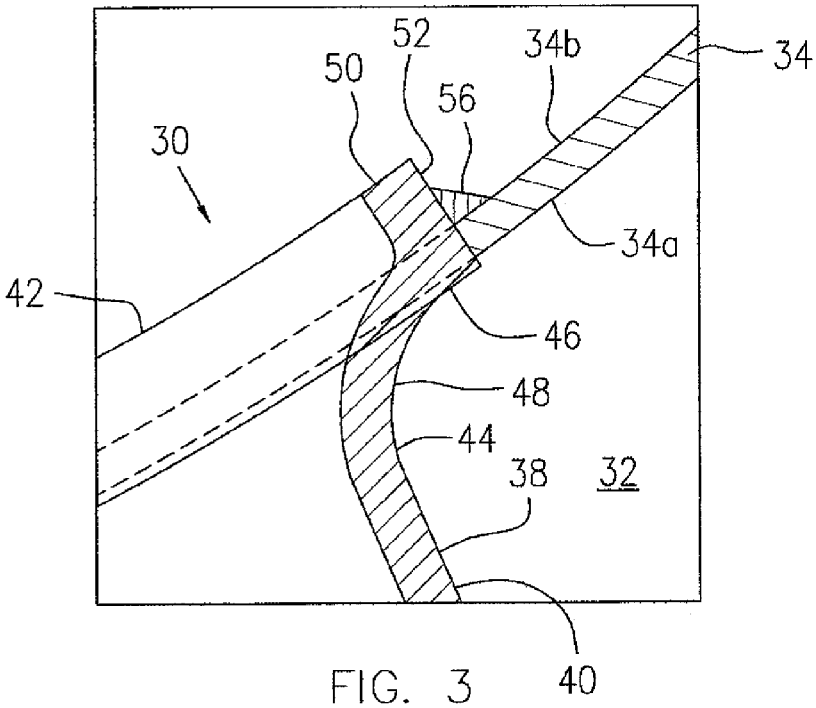
FIG. 3 is a partial cross-sectional view in an enlarged scale, of a circled area 3 of the vane ring shown in FIG. 2.
Figure 4:
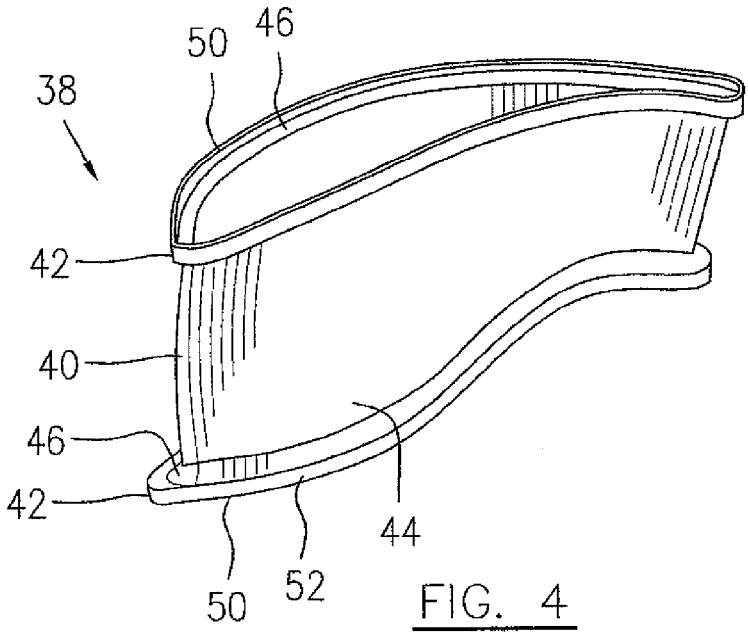
FIG. 4 is a perspective view of a strut used in the vane ring of FIG. 2.
Figure 5:
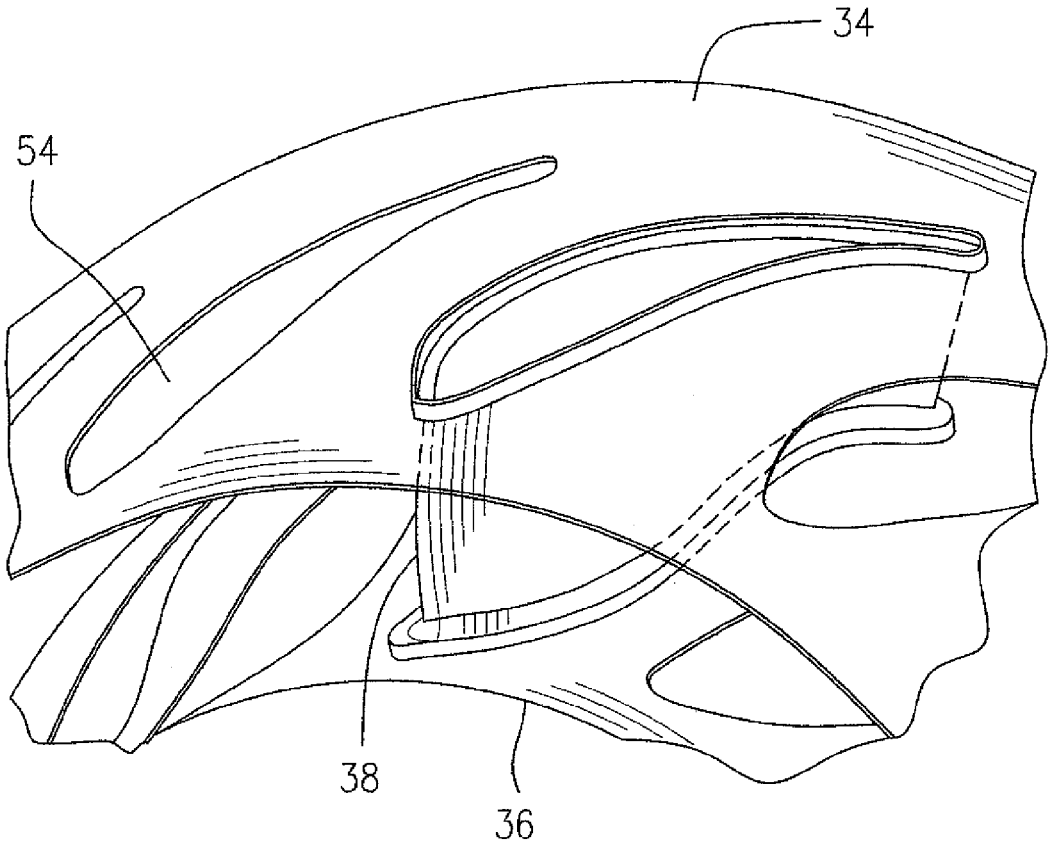
FIG. 5 is a partial perspective view of the vane ring of FIG. 2 in a manufacturing procedure in which only one strut has been welded to the respective outer and inner annular duct walls of the vane ring.

Each strut 38, as better illustrated in FIGS. 3 and 4, has an aerodynamic profile in cross-section, and may be configured in a hollow configuration according to one embodiment, defined by for example, a shell wall (not numbered). Each of the struts 38 generally has a body portion 40 which forms a substantially major part of the strut, with opposed end portions 42. Each of the end portions 42 includes a transit radial portion 44 extending from the body portion 40 and an enlarged section 46 extending laterally and outwardly from the transit radial portion 44 to provide a transitional inner curve 48 having a predetermined fillet radius between the transit radial portion 44 and the enlarged section 46. The enlarged section 46 is welded or brazed to the back surface 34*b* or 36*b* of the respective outer and inner duct walls 34, 36 (FIG. 3 shows only one junction of the strut 38 and the outer duct wall 34).

The enlarged section 46 of the strut 38 may have a shape substantially similar to a cross-sectional shape of the adjacent transit radial portion 44. Optionally, the enlarged section 46 may include a radial projection 50 extending along an outer periphery of the enlarged section 36. The radial projection 50 of the enlarged section 46 may optionally include a machined outer peripheral surface 52 which substantially mates with, and is welded or brazed to a periphery of respective openings 54 defined in the respective outer and inner duct walls 34, 36 (see FIG. 5) when the radial projection 50 extends radially through the respective openings 54. A fillet weld or braze 56 may be applied around the radial projection 50 to join the machined outer peripheral surface 52 of the radial projection 50 with the back surface 34*b* (or 36*b*) of the outer duct wall 34 (or inner duct wall 36).

The outer and inner duct walls 34 and 36 may be formed from sheet metal. However, the opposed ends 34*c*, 34*d*, 36*c* and 36*d* may be made from different material and may be welded or brazed to the sheet metal outer and/or inner duct walls 34 and 36.

Figure 6:
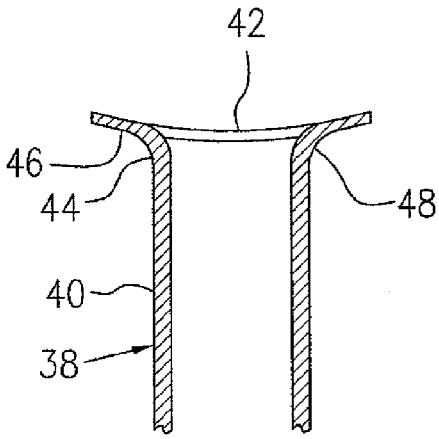
FIG. 6 is a schematic partial cross-sectional view of a strut showing integration of the enlarged end section with the body portion of the strut according to one embodiment.
Figure 7:
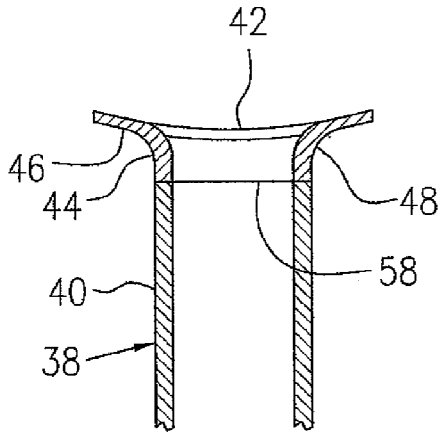
FIG. 7 is a schematic partial cross-sectional view of a strut showing integration of the enlarged end section with the body portion of the strut according to another embodiment.

Referring to FIGS. 3, 6 and 7, there is shown only one end portion 42 because the opposed end portions of the strut 38 are substantially similar and will be generally described as the end portion 42. The entire end portion 42 is made from only one metal material. The one-material end portion 42 may be made as a flared strut end which is formed as an integral part of the strut during a formation procedure of the strut 38, as shown in FIG. 6. For example, the body portion 40 of the end portion 42 of the strut 38 may be formed together by one piece of sheet metal in a sheet metal pressing procedure. Alternatively, the body portion 40 and the end portion 42 of the strut 38 may be formed together as a single cast component.

Optionally, the end portion 42 may be fabricated separately from the body portion 40 of the strut 38, and then welded or brazed to the body portion 40 (as indicated by line 58) such that the outer surface of the transit radial portion 44 of the end portion 42, has an outer surface as a smooth extension of the outer surface of the body portion 40, as shown in FIG. 7. For example, the separately fabricated end portion 42 may be made from a single cast component or a forged component with a machined inner curve 48. The body portion 40 of the strut 38 may be made of sheet metal or a cast component.

Figure 8:
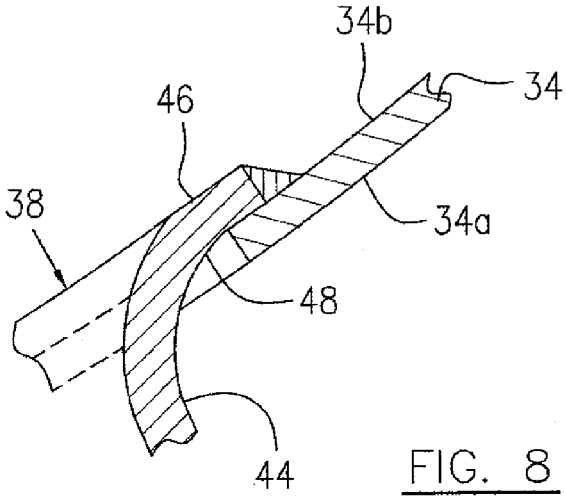
FIG. 8 is a partial cross-sectional view in an enlarged scale, of a vane ring according to an embodiment alternative to that shown in FIG. 3.

Referring to FIG. 8, the enlarged section 46 may not mate with the opening 54 defined in the outer or inner duct walls 34 or 36, but extends outwardly to form a fold-lip over the periphery of the opening 54. The enlarged section 46 therefore overlaps and joins the outer or inner duct walls 34 or 36. It should be noted that only one end portion 42 of each strut 38 may be made in this configuration in order to avoid difficulties in fabrication of the vane ring 30.

Figure 9:
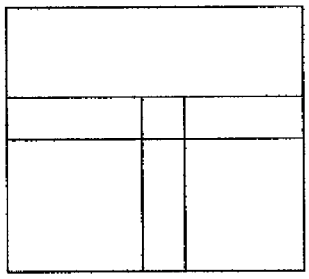
FIG. 9 PRIOR ART
FIG. 9 is a schematic illustration of a junction between a strut and a duct wall of a conventional vane ring before a welding procedure is performed.
Figure 10:
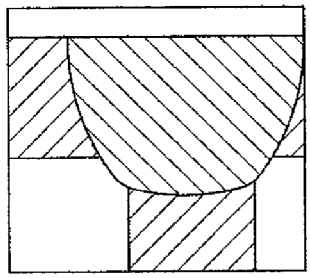
FIG. 10 PRIOR ART
FIG. 10 is a schematic illustration of the junction of between strut and duct wall of the conventional vane ring of FIG. 9, showing a sharp corner and uncontrolled fillet radius resulting from a welding procedure.

In contrast to the prior art shown in FIGS. 9 and 10, the described subject matter as evidenced in the above embodiments, provides a fabricated transitional inner corner curve between the radial portion 50 and the enlarged section 46, independent from any welding and brazing passages used in the prior art. Therefore, it is more controllable to determine the fillet radius of such an inner corner curve 48. The enlarged section 46 of the strut 38 actually becomes part of the respective outer and inner duct walls 34, 36. The fabricated inner corner curve 48 advantageously results in less stress, in contrast to the sharp corner formed at the junction of the strut and the duct walls of the prior art.

The above description is meant to be exemplary only, and one skilled in the art will recognize that changes may be made to the embodiments described without departure from the scope of the invention disclosed. For example, a strut having a hollow configuration is described as an embodiment to illustrate the described subject matter. However, the described subject matter is also applicable to solid struts. In such a case, the end portion of a strut may be made together with or separately from the body portion of the strut, for example, by machining a metal bar bracket. The described subject matter not only can be used for a fabricated static vane ring as described, but may also be used for other types of vane rings such as segmented vane rings. The struts may be joined to the respective outer and inner duct walls differently in any specific application. The described subject matter may be used to join the struts to either outer or inner duct walls, as desired. Still other modifications which fall within the scope of the described subject matter will be apparent to those skilled in the art, in light of a review of this disclosure, and such modifications are intended to fall within the appended claims.

The invention claimed is:

1. A static vane ring for a gas turbine engine comprising:

an annular duct defined between an annular outer duct wall and an annular inner duct wall, each of the outer and inner duct walls defining a gas path surface and a back surface opposed to the gas path surface;

a circumferential array of aerodynamic struts extending radially across the duct and fixedly mounted to the outer and inner duct walls wherein each strut has a hollow configuration defined by a shell wail and opposed enlarged ends each including an enlarged hollow section extending laterally and outwardly from the shell wall of a transit radial portion, and at each enlarged end a fillet radius defined between the transit radial portion and the enlarged hollow section, the enlarged hollow section received in an opening defined in a corresponding one of the outer and inner duct walls, the enlarged end including a radial projection defined along an outer periphery of the enlarged hollow section and projecting radially from the enlarged hollow section, thereby defining an enlarged opening within the radial projection in communication with the hollow configuration of the strut, and wherein a welded or brazed joint extends between the corresponding back surface and the enlarged hollow section, and wherein an interior surface of the enlarged hollow section curves between the transit radial portion and the enlarged section.

2. The static vane ring as defined in claim 1 wherein the enlarged hollow section has a shape substantially similar to a cross-sectional shape of the transit radial portion.

3. The static vane ring as defined in claim 1 wherein the radial projection extends radially through the opening to project from the corresponding back surface, and has a machined outer peripheral surface.

4. The static vane ring as defined in claim 1 wherein the transit radial portion of the enlarged end comprises an outer surface as a smooth extension of an outer surface of the shell wall of the strut.

5. The static vane ring as defined in claim 1 wherein the enlarged end is one of a cast component and a forged component.

6. The static vane ring as defined in claim 1 wherein the enlarged hollow section has an outer periphery mating with a periphery of the opening of the corresponding one of the outer and inner duct walls.

7. The static vane ring as defined in claim 1 wherein the enlarged end is a machined metal component.

8. The static vane ring as defined in claim 1 wherein each of the struts, including the enlarged end, is a Cast component.

9. The static vane ring as defined in claim 1 wherein each strut, excluding the enlarged end, is made of sheet metal.

10. The static vane ring as defined in claim 1 wherein the enlarged end is welded or brazed to the body portion of each strut.

11. The static vane ring as defined in claim 1 wherein the enlarged end comprises only one metal material.

12. A strut configuration for radially interconnecting outer and inner duct walls of a static vane ring used in a gas turbine engine, the strut having a hollow configuration and comprising a hollow body portion with opposed hollow end portions, each of the hollow end portions including a hollow transit radial portion extending from the hollow body portion and an enlarged hollow section extending laterally and outwardly from the hollow transit radial portion, and a fillet radius between the hollow transit radial portion and the enlarged hollow section the hollow transit radial portion being integrated with the hollow body portion such that an outer surface smoothly extends from the hollow body portion to the hollow transit radial portion, each enlarged hollow section having a profile substantially similar to a cross-sectional aerodynamic profile of the adjacent hollow transit radial portion, adapted to be integrated with one of the outer and inner duct walls of the static vane ring, and wherein the enlarged hollow section comprises a radial projection, projecting radially from and extending along an outer periphery of the enlarged hollow section to thereby define an enlarged opening within the radial projection in communication with the hollow configuration of the strut, the outer periphery including a machined peripheral surface, and wherein interior surface of the enlarged hollow section curves between the transit radial portion and the enlarged section.

13. The strut configuration as defined in claim 12 wherein the hollow body portion comprises a shell wall made of sheet metal, defining the hollow configuration.

14. The strut configuration as defined in claim 12 wherein the opposed hollow end portions are each a cast component.

15. The strut configuration as defined in claim 12 wherein the opposed hollow end portions are each a forged component.

16. The strut configuration as defined in claim 12 wherein the opposed hollow end portions are each a machined component.

* * * * *